United States Patent [19]

Bedi

[11] Patent Number: 5,044,334

[45] Date of Patent: Sep. 3, 1991

[54] PROCESS FOR CLEAN SIMPLE AND HIGH SPEED OIL CHANGE AND/OR FLUSHING OF THE MOVING COMPONENTS OF THE CRANKCASE IN AN INTERNAL COMBUSTION ENGINE

[75] Inventor: Ram D. Bedi, Birmingham, Mich.

[73] Assignee: K. J. Manufacturing Co., Wixom, Mich.

[21] Appl. No.: 484,344

[22] Filed: Feb. 22, 1990

Related U.S. Application Data

[63] Continuation-in-part of Ser. No. 413,008, Sep. 26, 1989, Pat. No. 4,964,373, which is a continuation-in-part of Ser. No. 350,303, May 11, 1989, Pat. No. 4,884,660.

[51] Int. Cl.[5] ..... F01M 1/00

[52] U.S. Cl. ..... 123/196 R; 184/1.5

[58] Field of Search ..... 123/196 R, 196 S; 184/1.5

[56] References Cited

U.S. PATENT DOCUMENTS

| | | | |
|---|---|---|---|
| 1,886,098 | 11/1932 | Hedglon . | |
| 2,158,914 | 5/1939 | Rinehart | 185/1.5 |
| 2,249,303 | 7/1941 | Smith | 184/1.5 |
| 2,320,048 | 5/1943 | Parson | 184/1.5 |
| 2,366,073 | 12/1944 | Vallerie | 134/21 |
| 2,425,848 | 8/1947 | Vawter | 210/62 |
| 2,545,585 | 11/1948 | Alderman | 134/13 |
| 2,554,389 | 5/1951 | Stevens | 134/167 |
| 2,594,779 | 4/1952 | Huffman | 184/1.5 |
| 3,489,245 | 1/1970 | Broadwell | 184/1.5 |
| 4,508,195 | 4/1985 | Millet | 123/196 R |
| 4,674,456 | 6/1987 | Merritt | 123/196 S |
| 4,776,431 | 11/1988 | Poling | 184/1.5 |
| 4,807,674 | 2/1989 | Sweet | 141/59 |
| 4,854,277 | 8/1989 | Kenney | 123/196 A |

*Primary Examiner*—E. Rollins Cross

*Attorney, Agent, or Firm*—Basile and Hanlon

[57] ABSTRACT

A process and apparatus for changing the oil in an engine and/or flushing and/or cleaning the moveable parts in the engine. The device includes an oil filter adapter adapted to be positioned in the oil filter boss, a remote oil filter mounting boss and inlet and outlet hoses connecting the two. The device is attached to the engine. Suitable pump-out and fill lines are connected to the device and can be releasably attached to an external pump device. When the device is employed to change oil, the external pump device is connected, and spent oil removed from the oil pan under suction force through the pump-out line. A measured amount of fresh oil is then introduced through pump-out line alone or through the pump-out line and the fill line and internal lube oil distribution system. Once accomplished, the external pump device can be uncoupled. When thorough cleaning is required, a suitable flushing fluid is introduced under pressure through the fill line and the internal oil distribution system after the spent oil is pumped out to scrub clean the internal passages and surfaces. The flushing fluid can be recirculated as desired to achieve thorough cleaning and, then, removed through the pump-out line.

14 Claims, 4 Drawing Sheets

PROCESS FOR CLEAN SIMPLE AND HIGH SPEED OIL CHANGE AND/OR FLUSHING OF THE MOVING COMPONENTS OF THE CRANKCASE IN AN INTERNAL COMBUSTION ENGINE

CROSS-REFERENCE TO RELATED APPLICATIONS

This application is a continuation-in-part of Ser. No. 07/413,008 filed on Sept. 26, 1989 which is a continuation-in-part of Ser. No. 350,303 filed on May 11, 1989 both of which are currently pending before the United States Patent Office.

BACKGROUND OF THE INVENTION

1. Field of the Invention

This invention relates to a method and device for changing motor oil, and, optionally, flushing the motor oil reservoir and crankcase components in internal combustion engines of all sizes. Such internal combustion engines can be found on automobiles, trucks, tractors, heavy earth moving equipment, military equipment, or the like. More particulaly, this invention relates to processes in which residual spent oil and other contaminants which adhere to the surfaces of the internal engine oil distribution channels of the engine components such as the crankshaft, bearings, connecting rods, etc, in the crankcase are expendiently removed. This invention also relates to a device and method for removing the degraded spent motor oil and replacing it with a suitable amount of fresh motor oil in an integrated self-contained process at high speeds with almost no exposure to the oil vapors of the spent engine oil.

2. Background of the Relevant Art

The benefits of routine oil changes to internal combustion engines are well known. Routine oil changes have been shown to increase engine life and performance. With repeated prolonged use, motor oil builds up metallic and non-metallic suspended particles from the abrasive and or adhesive wear of engine parts against one another and from products of incomplete combustion and improper air intake. The particles, in turn, cause abrasive wear of the engine bearings, piston rings and other moving parts and result in the reduction of the motor oil lubricity as various additives and lubricating components become depleted. This adversely effects engine performance and, if left unchanged, can destroy or cripple the engine performance. It is recommended by at least one oil manufacturer that the level of total solid concentration be limited to levels below 3.0% with levels of silica being present in amounts lower than 25 ppm and sodium in amounts lower than 200 ppm.

To obtain satisfactory automotive engine performance, and maintain solid concentration levels in the motor oil lower than the recommended 3.0%, changing the motor oil in an automobile engine is a necessary, but an undesirable, dirty, and time-consuming task. In currently designed vehicles, the oil pan serves the purpose of a reservoir for circulation of engine oil. Engine lubrication is generally accomplished through a gear-type pump. The pump picks up engine oil from the oil pan sump, where oil is drawn up through the pick-up screen and tube, and past through the pump to the oil filter. The oil filter is generally a full flow paper element unit. In some vehicles, an oil filter bypass is used to insure adequate oil supply, should the filter become plugged or develop excessive pressure drop. Oil is routed from the filter to the main oil gallery. The gallery supplies valve train components with oil, and by means of intersecting passages, supplies oil to the cam shaft bearings. Oil draining back from the rocker arms is directed, by cast dams in the crank case casting, to supply the cam shaft lobes. Oil also drains past specific hydraulic lifter flats to oil cam shaft lobes directly. The passages supplying oil to the cam shaft bearings also supply the crank shaft main bearings through intersecting passages. Oil from the crank shaft main bearings is supplied to the connecting rod bearings by means of intersecting passages drilled in the crank shaft. The front cam bearing can include a slot on its outside diameter to supply oil to the cam sprocket thrust face. In some engines, many internal engine parts have no direct oil feed and are supplied either by gravity or splash from other direct feed components. A bypass valve can also be disposed in the oil pick-up screen to insure adequate oil flow if the screen should become restricted. A pressure regulator valve, sometimes located in the oil pump body, maintains adequate pressure for the lubrication system and bypasses any excess back to the suction side of the pump. The full flow oil filter is generally mounted on a machined boss on the side of the engine. Oil from the pump passes through the filter before going to the engine oil galleries. In the filter, the oil passes through a filtering element where dirt and foreign particles are removed.

To remove contaminated oil, the drain plug, generally located in the lowermost region of the oil pan, is opened. The degraded (spent) oil containing suspended particles is permitted to flow under gravity out of the pan into a suitable receptacle. After the spent oil is removed, the used oil filter can be removed and replaced. The drain plug can, then, be replaced and fresh oil added to the engine; usually through a separate opening, such as in the engine valve cover.

The process of gravity drainage does not remove all of the spent oil with its metallic and non-metallic particulates because gravity drainage provides only minimum scrub cleaning or scouring action and cannot dislodge strongly adhering particulates and degraded oil components. A significant portion sticks to the oil pan walls, as well as to the surfaces and passages of engine components such as the crank shaft, connecting rods, pistons engine block, cylinder head and the like. These particles remain to be mixed with fresh motor oil. Thus the concentration of contaminants is lowered by dilution and only a part of the total contaminants are eliminated.

The oil change process is essentially the same whether performed at home, at service stations or at one of the various rapid oil change centers which have opened in recent years. Spent or dirty oil is allowed to collect in the oil pan and is, then, permitted to drain from the oil pan through the drain plug opening located in the lowermost portion of the oil pan. The drain plug opening is, then, closed and fresh oil is added to the crankcase and oil pan through a suitable opening such as the valve cover.

In this basic procedure, the oil pan and crankcase never drain completely. Oil containing suspended, gelatinous, and sticky particles remains on the walls of the pan and the surfaces of the crankcase components, and in the various oil distribution passages, to mix with the fresh oil added during the conventional oil change process and subsequent engine use. This reduces the life of the oil filter which, in turn, further reduces the life of the engine itself over an extended period of time.

Removal of the used oil filter is also a messy environmentally unacceptable and undesirable procedure. The used filter must be unscrewed and removed without spilling the large amount of oil remaining within it.

The commercially available oil change process is also limited by the time required for oil drainage. The flow rate, or time required for oil drainage, is the same for each of these locations, because it is limited by the size of the drain plug aperture and the force of gravity. Service stations and other locations simplify the process of oil drainage with the use of hydraulic racks, special oil collection receptacles and the like. However, this specialized and expensive equipment is not readily available to the typical automotive owner who may wish to change the oil in his vehicle at home. It has been estimated that the retail market of oil is approximately 2.83 billion quarts or approximately 700 million gallons. The do-it-yourself individual has been found to be price sensitive, and tends to distrust the quality of service stations and other oil change centers. The do-it-yourself individual typically believes that if you want a job done right, you do it yourself. However, the current design of vehicles does not lend itself to do-it-yourself oil changes in a convenient clean and effortless manner. Many vehicles have low ground clearance making it difficult to access the oil drain plug for removal of the spent oil, and also making it difficult to collect the oil without contaminating the surrounding environment.

Environmental protection is a prominent social issue in our present society. Therefore, it would be desirable to encourage do-it-yourself oil changers to perform this type of task in an environmentally safe manner. It is estimated that there are approximately 119 million privately owned passenger vehicles. These vehicles require approximately 360 million oil changes a year, using an average of 1.2 gallons per change based on an average oil change frequency of 2.94 times a year. This amounts to approximately 550 million gallons of motor oil a year. Of this amount, it is estimated that 70% of motor oil is installed by motorists themselves. It is believed that pursuant to present practice, the spent oil drained by motorists finds its way into spent household containers, such as milk cartons. The household containers are closed and disposed of in the garbage which can and will finally find its way into the local waste dump. As the house hold container deteriorates, the oil and its contaminates will eventually seep into the ground water surrounding below the dump site. It has been estimated that 6.6 million barrels of oil a year seeps into U.S. soil creating serious potential ground water pollution problems. It would be desirable environmentally and economically if this oil could be collected and recycled. In order to motivate the do-it-yourself market, it is desirable in the present invention to make the collection of oil from the oil pan as well as the fitting during oil changes effortless, clean and inexpensive.

Conservation of energy and the trade deficit are also major issues in today's society. It is estimated that 250–360 million gallons of spent oil can now be easily collected and profitably recycled. The price of spent oil so collected is four dollars per barrel at best, while the price of crude oil is much greater at approximately $18.00 per barrel. Recycling easily collected spent oil could decrease the trade deficit by approximately 120 million dollars, while providing a profitable recycling economy of approximately 86 million dollars per year.

Therefore, it would be desirable to provide a method which accelerates removal of spent oil from the oil pan and the filter more completely and easily from the crank case. It would also be desirable to provide a system which reduces the amount of spent oil handling as required in the conventional oil change service station. Finally, it is desirable to provide a method which could be easily employed by all the vehicle owners whether at home or at a convenient service station with all the benefits of the method of the present invention such as time savings, money savings, convenience, minimum exposure to motor oil, minimize pollution of land and waterways, energy conservation, trade deficit reduction, and finally longer lasting, better performing engines.

SUMMARY OF THE INVENTION

The present invention is a process and apparatus for high speed oil change in an internal combustion engine having a crank case and an oil pan. The process can also include optional flushing steps. The device of the present invention includes an oil filter adapter sealingly connected to the oil filter mounting boss. The adapter has at least two openings to which a first inlet hose and a second outlet hose are attached. The first inlet hose and second outlet hose are connected to a remotely disposed oil filter mounting boss to which the engine oil filter can be sealingly mounted. The remotely disposed mounting boss has a bracket which can be attached to the exterior surface of the cylinder head or engine block or any readily accessible position under the hood.

The device also includes a separate pump-out hose which is attached to the drain opening of the oil pan by means of a drain opening adapter. The pump-out hose has a suitable quick connect suction fitting which can be releasably connected to an external pump device which can direct the fluid flow at will. Optionally, an external pump device may be suitably equipped to permit reversal of the direction of fluid flow in the pump out hose and also safe gases under pressure preferably air. In this manner, fresh lube oil can be introduced into the oil pan through the pump-out hose and drain opening adapter if necessary.

The second outlet hose has a first end connected to the remotely dispposed mounting boss and a second end attached to the oil filter adapter in a manner which permits the second outlet hose to be in fluid communication with the internal lube oil circulation passages in the various engine components. A fill line having a suitable quick connect pressure coupling is connected to the first inlet hose a location upstream of the oil filter between the oil filter and the engine.

In the method of the present invention, a clean rapid efficient oil change can be performed using the device described previously by connected the quick connect pressure and suction members to mating members on a suitable external pump device. Once connected, a suction force can be exerted through the pump-out line to remove spent oil collected in the oil pan. Once the spent oil is removed the old oil filter may be replaced with a new filter and an appropriate amount of fresh motor oil is introduced under safe pressure (less than 50 psi) into the internal lube oil circulation passages through the fill line and the first inlet hose. The pumping pressure is sufficient to permit contact between the fresh oil and the moveable engine parts when oil is introduced through the lube oil circulation passages. The amount of fresh lube oil introduced is that which is appropriate for the respective engine. After the fresh oil is introduced the coupling members are removed and normal oil circulation through the filter can commence.

Where thorough crankcase cleaning and flushing is required, a suitable flushing fluid may be introduced through the fill line and first inlet hose at any time before, during or after removal of the spent oil. The flushing fluid is introduced under sufficient but safe pressure to induce a spraying pattern which facilitates contact between the flushing and all remote surfaces of the crankcase components. Flushing fluid introduced after removal of spent oil may be filtered to remove particulate contaminants and reintroduced to the crankcase until cleaning is complete.

After cleaning is complete, the flushing fluid can be removed and if desired remaining flush fluid may be removed by introducing the required amount of fresh material through the oil passages, recirculation if needed and then pumping it out. A small amount of fresh oil may then be added, circulated and pumped out. This renders the engine crankcase essentially free from any amount of flush fluid. Now fresh motor oil is introduced in the manner described previously.

BRIEF DESCRIPTION OF THE DRAWING

In the present description, reference is made to the following drawing in which like reference numerals are used to refer to like elements throughout the similar views and in which.

DESCRIPTION OF THE PREFERRED EMBODIMENT

The basic process of the present invention can be employed sucessfully with vehicles having internal combustion engines which have oil pans or similar oil reservoirs and internal lube oil distribution passage systems. The term "internal oil lube distrubtion passage system" is defined as, but not limited to, the machined passages and circulation systems present in the engine block, cylinder head, crank shaft, cam shaft and connecting rods. Various engines will have differing lubrication requirements. Therefore it is understood that every engine may not have passages of circulation systems in all the enumerated components.

THE APPARATUS

Figure 1:
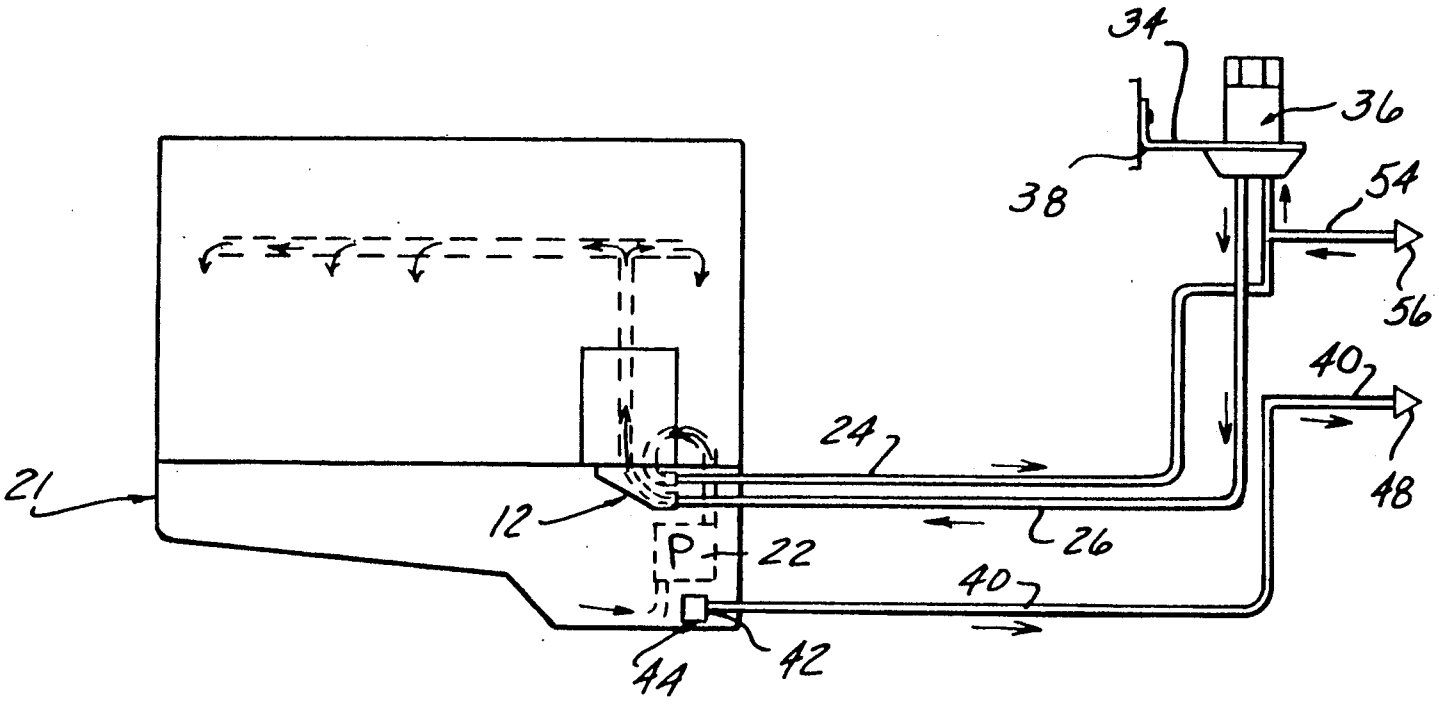
FIG. 1 is a schematic representation of the device of the present invention.
Figure 2:
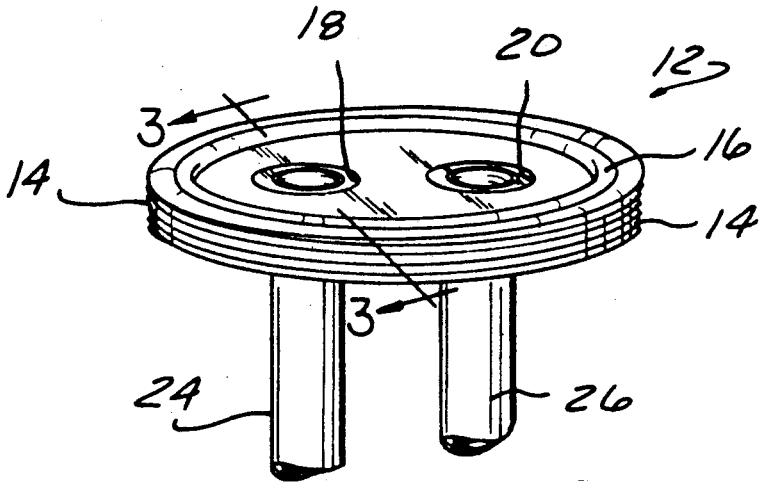
FIG. 2 is a detail drawing of the top view of oil filter adapter of the present invention.
Figure 3:
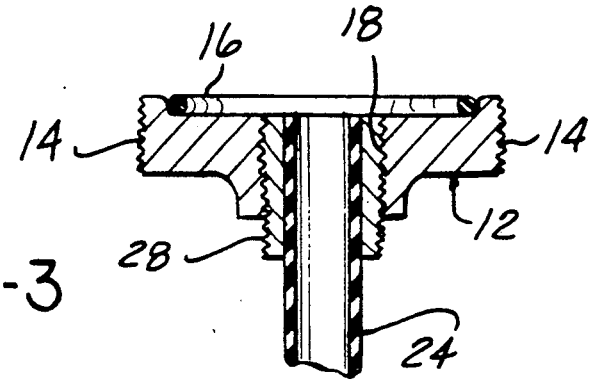
FIG. 3 is a cross-sectional view of the oil filter adapter taken along the 3—3 line of FIG. 2.
Figure 4:
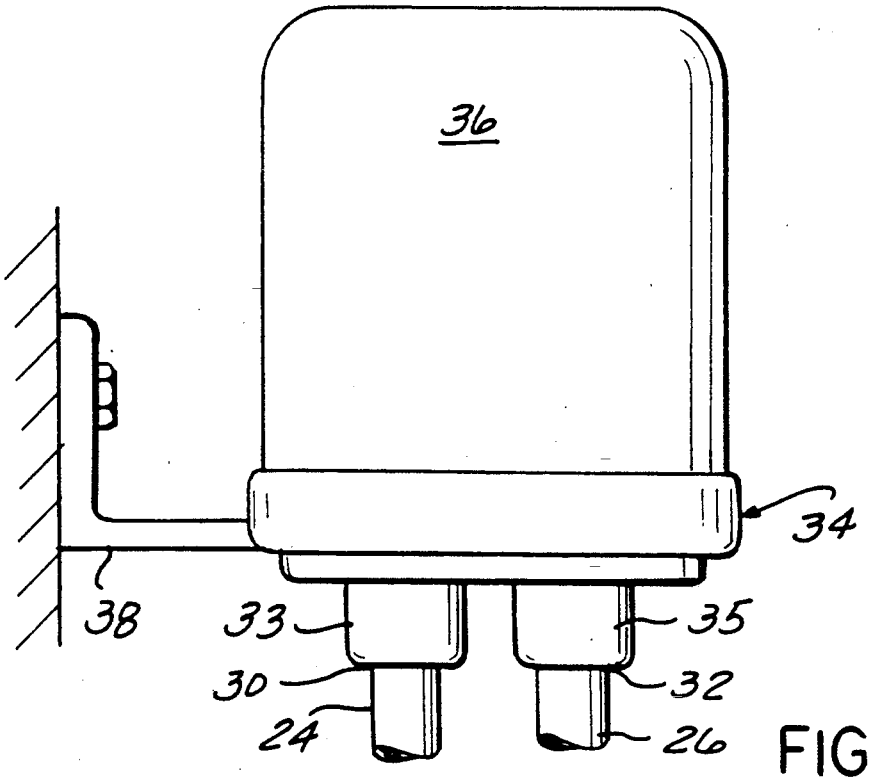
FIG. 4 is a detail drawing of the oil filter and remote oil filter mounting boss.

The apparatus 10 of the present invention, depicted schematically in FIG. 1, includes an oil filter adapter 12 shown in detail in FIGS. 2 and 3. The oil filter adapter 12 has an exterior threaded surface 14 and a suitable sealing member such as sealing gasket 16 which will permit it to be inserted into the oil filter mounting boss located in the engine block of the associated internal combustion engine (not shown). The oil filter adapter 12 has at least two openings, a first inlet opening 18 and second outlet opening 20 through which introduced fluids may flow. The first inlet opening 18 is in fluid communication with the engine oil pump 22 located in oil pan 21 while the second outlet opening 20 is in fluid communication with the internal lube oil distrubution passage system of the moving engine components.

The detailed configuration of one opening 18 is shown in FIG. 3. It is to be understood that opening 20 may be similarly configured. Furthermore, it is to be understood that openings 18, 20 may be shaped or have additional components such as elbows or the like to permit easy installation in the engine compartment or a vehicle. As shown in FIGS. 2 and 3, openings 18 and 20 have first inlet hose 24 and second outlet hose 26, respectively, attached to them. Inlet hose 24 has a suitable fastening means such as threaded end 28 which can be sealingly received in opening 18. Outlet hose 26 may be similarly fastened.

Inlet hose 24 and outlet hose 26 terminate in second ends 30 and 32, respectively, which are attached to a remote oil filter mounting boss 34 to which oil filter 36 is sealingly attached. The remote oil filter mounting boss 34 generally has openings 33, 35 which are configured similarly to those in the oil filter adapter 12. Remote oil filter mounting boss 34 will generally have internal threads (not shown) to receive the oil filter 36. Remote boss 34 also has a mounting bracket 38 to permit mounting of the remote boss 34 to a suitable and accessible area of the exterior engine wall such as the crankcase cover.

The inlet hose 24, outlet hose 26 and oil filter 36 combine to make a circuit through which oil is pumped during engine operation. The oil pump 22 circulates the engine oil from oil pan 21, through inlet hose 24, through filter 36 and on to the various engine components through outlet hose 26 and the engine's internal oil distribution passage system during conventional engine operation.

Figure 5:
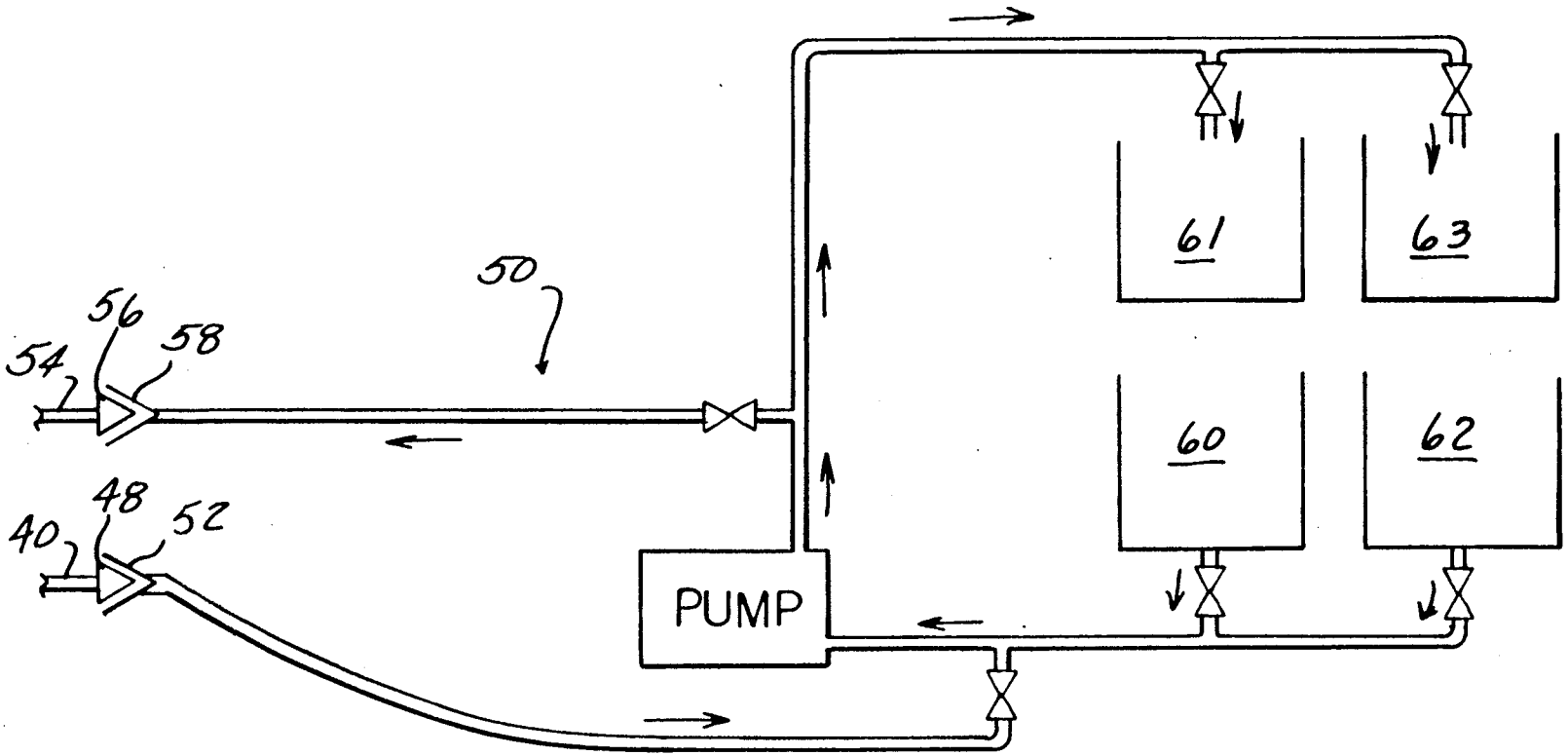
FIG. 5 is a schematic representation of the external recirculation pump employed in the present invention.
Figure 6:
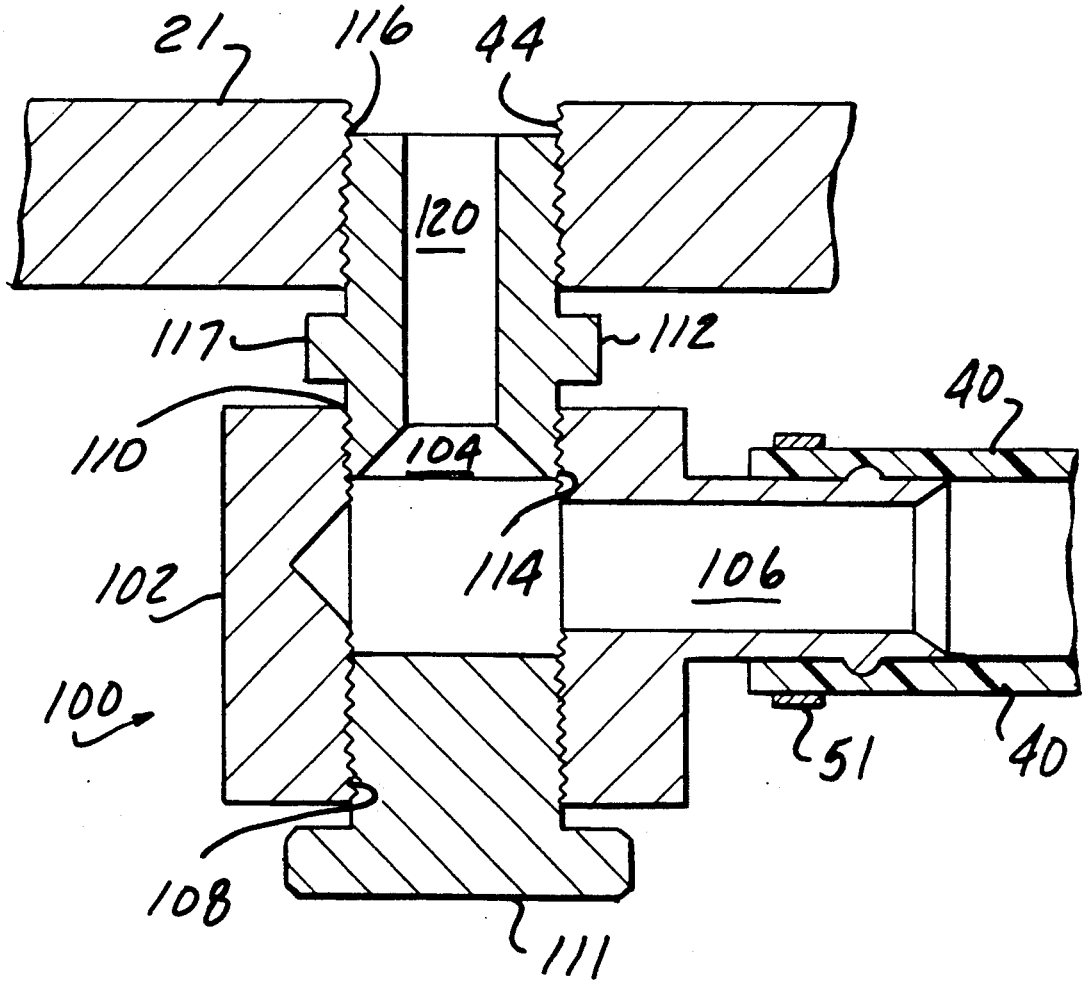
FIG. 6 is a cross-sectional representation of the drain plug adapter of the present invention.

The device 10 of the present invention also includes a pump-out line 40 which has a first secion 42 connected to oil pan 21 at the drain plug opening 44 of oil pan 21 by drain opening adapter 100 shown in FIG. 6. Alternately, in a modified version of this device, a pump-out line 40 and associated adapter 100 may be attached apart form or instead of the inlet and outlet hose 24 and respectively. Where employed alone, the pump-out line 40 can be used to accomplish oil pump-out and fill. Pump-out line 40 terminates in a quick connect suction coupling 48 adapted to be matingly received in a suitable coupling such as quick connect 52 on the external pump device 50 shown in FIG. 5 and described in detail subsequently.

Drain opening adapter 100 is composed of a body member 102 having a central throughbore 104 extending therethrough and a branch throughbore 106 which is in fluid communication with central throughbore 104 and is angularly oriented thereto. Central throughbore 104 has first and second threaded ends 108 and 110 respectively. The first end 108 is adapted to threadingly receive oil pan drain plug 111. The second threaded end 110 of central throughbore 104 is adapted to receive connecting shaft member 112 threadingly therein.

The connecting shaft member 112 includes in a first exteriorly threaded region 114 adapted to be threadingly received in the second threaded end 110 of central throughbore 104 and a second exteriorly threaded region 116 adapted to be threadingly received in the drain plug opening 44 of oil pan 21. To facilitate attachment of the drain opening adapter 100 in the drain plug opening 44 the connecting shaft member 112 may have a centrally positioned turn screw member 117 or other suitable fastening member. The connecting shaft member 112 has a throughbore 120 longitudinally extending therethrough to bring the oil pan interior into fluid communication with the central throughbore 104 and branch throughbore 106.

The pump-out line 40 is preferably attached to the drain opening adaptor 100 at the outlet of branch throughbore 106.

A fill line 54 is connected to the inlet hose 24, upstream or downstream of the filter 36. Fill line 54 has a quick connect suction coupling 56 adapted to be matingly received in a suitable coupling 58 on the external pump device 50. The fill line 54 includes suitable valves which can be open or closed to direct the desired fluid in the closed direction.

The external pump device 50 includes suitable storage tanks 60, 62 for holding flushing fluid, fresh motor oil and optional reservoirs for containing spent fluids 61, 63. The external pump device 50 is capable of producing sufficient pumping pressure to introduce flushing fluid or fresh motor oil into the engine in a spray pattern to administer the introduced material over the engine components, the oil pan interior and the lube passages in a scrub cleaning action thereby cleaning or lubricating the contacted surfaces depending upon the process being implemented.

There are certain situations where it may be necessary to accompllish pump-out and refill through line 40 and drain opening adapter 100 such as when there is no access to a pump device such as pump device 50 or when an engine is not equipped with the oil filler apparatus in fluid contact with the internal lube oil distribution passages previously describe. Thus, it is within the purview of this invention to employ the pump-out line 40 of the present invention as an independent means for achieving both pump-out and fresh oil filling by employing a suitable pumping device. or devices which can be attachd to the pump-out line 40 in the manner described previously.

THE PROCESS

In order to better understand the device 10 of the present invention, the oil change and crank case flushing process will now be discussed making reference to the various parts of the device 10 as necessary.

In the process of the present invention, the major portion of the spent oil is removed from the oil pan 21 by a positive suction force exerted on the spent oil by external pump device 50. The spent oil passes through pump out line 40 and is ultimately conveyed to a suitable holding reservoir (not shown) until the spent oil can be disposed of or recycled in an environmentally sound manner.

When a thorough crankcase cleaning is not required, an appropriate amount of fresh motor oil can be introduced into the engine through fill line 54 and second filter outlet hose 26. Because the outlet hose 26 is in fluid communication with the internal lube oil distribution passage system of the engine, the fresh oil thus introduced passes through the machined passages in the internal lube oil distribution system to lubricate even remote hard to reach surfaces of the moveable engine parts with fresh oil even prior to engine start up. The introduced oil which collects in the bottom of the oil pan is the appropriate quantity for recirculation through the lube oil distribution passage system when the engine is running and driving the internal oil pump 22.

The fresh motor oil is, preferably, introduced into the engine compartment under sufficient pressure to induce a spraying pattern in the oil as it exists the lube oil distribution passage system and enters the engine compartment. This spraying pattern will insure tht the majority of the engine part surfaces are covered with lubricating oil. The pressure necessary to achieve this spraying pattern will vary with the type and configuration of respective engine and the viscosity of the oil introduced. However, it is preferred that this introduction pressure be greater than the oil pressure during engine operation to insure adequate oil coverage. Pumping pressure during addition of the fresh oil is provided by the external pump device 50, and is sufficient to insure adequate oil coverage.

If desired or required, the oil filter 36 may be changed during the oil change process. This would preferably occur after removal of the spent oil from the crankcase.

In order to speed fresh oil transfer to the engine and oil pan, suitable valves in the pump-out line 40 may be opened to direct fresh oil through the pump-out line 40 into the oil pan 21.

It is also possible to employ the pump-out line 40 in combination with the drain opening adapter 100 to pump spent oil out of the oil pan and replace it with fresh motor oil using a suitable external pump device 50. In order to accomplish spent oil pump-out and replacement with fresh lube oil employing on the pump-out line 40 in combination with the drain plug adapter 100, a suitable suction line can be exerted through a suction line such as the suction line shown in the pump device 50 in FIG. 5. Spent engine lube oil is, then drawn out of the oil pan 21 in the manner described previously.

After pump-out is complete, refilling the oil pan with fresh engine lube oil is accomplished through the same drain plug adapter 100. Fresh engine lube oil flows inward from line 40, through branch throughbore 106 into main throughbore 104 and into the oil pan 21 throught the drain plug opening. Introduction of the fresh oil in this manner can occur utilizing any appropriately configured external pumping means. This external pumping means may be an appropriately configured reversible pump device (not shown); two separate pump devices for executing emptying and filling steps (not shown); or the external pump device 50. Where the external pump device 50 is employed, it is anticipated that after spent oil pump-out has been completed, the suction line can be removed from attachment to pump-out line 40 and replaced with the fill line of the external pump device 50 through which fresh oil can be delivered to oil pan 21.

When a complete crankcase flushing is desired, the suction and pressure hoses of the external pump device 50 are attached to the device 10 of the present invention. Once attached, flushing fluid can be introuduced through fill line 54 and filter outlet hose 26 into the engine compartment through the internal lube oil distribution passage system. The pressure for the introduced flushing fluid is provided by the external recirculating pump 50. The pressure with which the flushing fluid is introduced is sufficient to induce a spray pattern as the flushing fluid exits the internal lube oil distribution passage system so that the flushing fluid contacts the surfaces of the engine components and oil pan with sufficient but safe pressure to dislodge a portion of the residual spent oil and contaminants by mechanical scrubbing action.

The flushing fluid may be introduced before, after, or during the pump-out step. Where the spent oil is extremely viscous, it is desirable to add a portion of the flushing fluid before or during the pump-out step to reduce the oil viscosity by dilution and improve the flow characteristics of the spent oil. Once the oil is diluted or if dilution is not required, the spent oil is pumped out to an appropriate holding tank in the manner described previously. The remaining flushing fluid is introduced to continue the cleaning process.

While a certain amount of residual spent oil and contaminants are removed merely by the mechanical scrubbing action of the spray, additional amounts can be dissolved or removed due to the sheeting action of the flushing fluid as it trickles down the oil pan walls and due to the chemical interaction between the residual spent oil and the flushing fluid.

The flushing fluid introduced is any material or composition which is completely miscible with motor oil and exhibits suitable detergency and cleaning characteristics but is inert to the oil pan, gaskets, and associated engine components. It is also preferable that the flushing fluid provides sufficient lubricity or sheeting action to enhance the sheeting action of the flushing fluid dislodging particulate contaminants and carrying them with the flushing fluid as it flows under gravity back to the oil pan. The flushing fluid employed is, preferably, one which is compatible with waste oil and is not detrimental in any subsequent waste oil storing and recycling processes and one which does not deposit undesirable residual constituents which adhere to oil pan surfaces and engine components.

In the preferred embodiment, the flushing fluid employed in the present invention consists essentially of a hydrocarbon miscible with engine oil, a compatible detergent capable of improving the detergency of the flushing fluid and a lubricating additive capable of enhancing the sheeting action of the flushing fluid.

The hydrocarbon employed in the preferred embodiment is an organic fluid selected from the group consisting of high flash point kerosene and mixtures hereof. The flash point of the kerosene is preferably above about 150° F. It is to be understood that other fluids having similar characteristics to high flash point kerosene may be employed in admixture or substituted in the flushing fluid.

The detergent employed in the present invention is an organic fluid selected form the group consisting of butyl cellosolve, DOWFAX surfactants, and mixtures thereof. These and similar surfactants are employed in sufficient concentration to provide detergency in the flushing fluid and no ill side effects to the seals and engine components.

The lubricating additive employed in the flushing fluid is, preferably, a methyl ester having a carbon chain between twelve and twenty carbon atoms or mixtures of such methyl esters in an amount sufficient to provide lubricity and sheeting action to the flushing fluid.

In including the lubricating additive in the flushing fluid of the present invention, it was believed that the lubricating additive would impart characteristics which would increase the sheeting action and cleaning characteristics of the flushing fluid. It has been found, quite unexpectedly that the flushing fluid of the present invention also imparts a residual surface lubricity, which is advantageous in that it provides preliminary lubricant to the engine components as newly added fresh motor oil is added and circulated through the crankcase.

The introduced flushing fluid, dislodged contaminants and spent oil accumulate in the lowermost portion of the oil pan 21 during the spraying step. The flushing fluid which accumulates in the lowermost portion of the oil pan 21 is pumped out in the manner described previous in connection with the spent oil. The pumped-out flushing fluid is directed into contact with assorted filtration media contained in the external pump device 50 to filter out the contaminants and particulates dislodged from the engine components and contained in the flushing fluid. The so-filtered clear flushing fluid can then be recirculated back to the fill hose 54 for spraying reintroduction into the engine through the aforementioned oil passages. If desired, the quality of the pumped out material can be tested or viewed to determine the effectiveness of the cleaning process. Depending on the effectiveness of the cleaning process, the recirculation of flushing fluid continue as long as necessary until most of the undesirable contaminants have been removed.

Once the flushing fluid recirculation is completed, the flushing fluid is pumped out to a suitable holding tank. A small portion of fresh oil may then be added, circulated through the engine and removed. This process removes any residual flush fluid remaining in the engine. After all residual flush fluid is removed, an amount of fresh oil appropriate for the respective internal combustion engine is sprayed into the engine in the manner described previously under safe but sufficient pressure to contact the newly cleaned crankcase components and provide fresh relubricant film.

After the fresh oil has been added, the coupling members can be disconnected and the engine operated in the normal manner. The present invention provides a cleaner environment by the virtual elimination of oil vapors inhaled by the operator, a simplified, high speed oil change process and an enhanced cleaning process in which greater amounts of residual spent oil and contaminants can be removed in a manner which reduces the time necessary to accomplish an oil change, the mess associated therewith, and provides a cleaner crank case environment for the fresh motor oil. This improves motor filter life and improves engine performance.

Additionally, because the fresh oil is pumped in upstream of the oil filter, the newly installed oil filter is always filled with fresh oil prior to starting the engine. This is in marked contrast to the conventional method in which there is a lag time before the fresh oil reaches the engine components immediately after an oil and filter change. In the present invention, the presence of a lubricating film of oil on the moving engine components is assured even after the high speed oil/filter change process.

Having described the process of the present invention, what is claimed is:

1. A device for implementing a high speed oil change in an internal combustion engine, said internal combustion engine having an oil pan with an associated drain opening and removable drain plug, the device comprising:

a drain adapted having a body, a central throughbore with first and second outlets said throughbore extending through said body, a connecting bore in fluid communication with said central throughbore having a branch outlet, and means for sealingly retaining the drain plug in said first outlet of said connecting bore;

means for maintaining said second outlet in fluid communication with the drain opening;

an oil conveying conduit line connected to said branch outlet, said conduit having a first quick connect member at a remote end, said quick connect member adapted to removably contact an external pump device, fresh oil reservoir and spent oil reservoir.

2. The device of claim 1 wherein said maintaining means comprises a hollow shaft having a first end matingly receivable in the drain opening and a second end matingly receivable in said second outlet of said drain adapter.

3. The device of claim 2 wherein said external pump device comprises:

means for pumping fresh and spent oil;

at least one fluid conveying conduit in fluid communication with said pump means; and a second quick connect coupling member on said fluid conveying conduit adapted to be matingly connected to said first quick connect coupling member on said oil conveying conduit line.

4. The device of claim 1 further comprising:

an oil filter adapter adapted to be sealingly connected to an engine oil filter mounting boss located on the internal combustion engine, said adapter having at least two openings, a first opening in fluid communication with an engine oil pump located in the oil pan and a second opening in fluid communication with an internal lube oil distribution passage system of the engine;

a remote oil filter mounting boss having first and second apertures, said mounting bracket positioned on the engine remote from said engine oil filter mounting boss;

an oil filter removably mounted on said remote oil filter mounting boss;

a first inlet hose connected to said first opening and said first aperture of said mounting bracket;

a second outlet hose connected to said second opening and said second aperture on said mounting bracket; and a fill line connected to said second outlet hose said fill line having a coupling member attached at a remote end, said coupling member adapted to removably contact said external pump device.

5. A process for changing oil in an internal combustion engine having an oil pan with an associated drain opening and removable drain plug, equipped with a high speed oil change device, the device including:

a drain adapter having a body, a central throughbore with first and second outlets said throughbore extending through said body, a connecting bore in fluid communication with said central throughbore having a branch outlet, and means for sealingly retaining the drain plug in said first outlet of said connecting bore;

means for maintaining said second outlet in fluid communication with the drain opening;

an oil conveying conduit line connected to said branch outlet, said conduit having a first quick connect member at a remote end, said quick connect member adapted to removably contact an external pump device, fresh oil reservoir and spent oil reservoir, the process comprising the steps of;

connecting said oil conveying conduit line to said external pump device;

removing spent oil from the oil pan by applying a suitable suction force though said oil conveying conduit line on said spent oil, said suction force exerted by said external pump device; and after spent oil is removed, introducing a measured amount of fresh oil through said oil conveying conduit line into the oil pan.

6. A process for changing oil in an internal combustion engine having an oil pan with an associated drain opening and removable drain plug, equipped with a high speed oil change device, the oil change device including:

a drain adapter having a body, a central throughbore with first and second outlets, said throughbore extending through said body, a connecting bore in fluid communication with said central throughbore having a branch outlet, and means for sealingly retaining a drain plug in a drain opening in an associated oil pan associated with the internal combustion engine in said first outlet of said connecting bore;

means for maintaining said second outlet in fluid communication with the drain opening;

an oil conveying conduit line connected to said branch outlet, said conduit having a first quick connect member at a remote end, said quick connect member adapted to removably contact an external pump device, fresh oil reservoir and spent oil reservoir;

an oil filter adapter adapted to be sealingly connected to an engine oil filter mounting boss located on the internal combustion engine, said adapter having at least two openings, a first opening in fluid communication with an engine oil pump located in the oil pan and a second opening in fluid communication with an internal lube oil distribution passage system of the engine;

a remote oil filter mounting boss having first and second apertures, said mounting bracket positioned on the engine remote from said engine oil filter mounting boss;

an oil filter removably mounted on said remote oil filter mounting boss;

a first inlet hose connected to said first opening and said first aperture of said mounting bracket;

a second outlet hose connected to said second opening and said second aperture on said mounting bracket; and a fill line connected to said second outlet hose said fill line having a coupling member attached at a remote end, said coupling member adapted to removably contact said external pump device.

the process comprising the steps of:

connecting said oil conveying conduit line and said fill line to said external pump device;

removing spent oil from the oil pan by applying a suitable suction force through said oil conveying conduit line on said spent oil contained in said oil pan, said suction force exerted by said external pump device;

after said spent oil is removed, introducing a measured amount of fresh oil into the engine through the fill line in communication with the internal lube oil distribution passage system and said oil conveying conduit line in fluid communication with said fluid conveying conduit, said fresh oil introduction under sufficient pressure to produce a spray pattern sufficient to permit contact between said fresh motor oil and moveable engine parts; and uncoupling said pump out line and said fill line from said external pump device after said fresh oil is introduced.

7. The process of claim 6 further comprising the steps of:

introducing a flushing fluid through said fill line and the internal lube oil distribution passsage system, said flushing fluid under sufficient pressure to create a spray pattern whereby said flushing fluid contacts exposed surfaces of the moveable engine parts and the oil pan surfaces;

removing spent oil and introduced flushing fluid from the oil pan through said oil conveying conduit line.

8. The process of claim 7 wherein said flushing fluid is recirculated through said external pump device and reintroduced into the engine through said fill line.

9. The process of claim 8 wherein said recirculated flushing fluid is brought into contact with said oil filter prior to reintroduction into the engine.

10. The process of claim 8 wherein said flushing fluid is brought contact with at least one external filtration media device prior to reintroduction into the engine.

11. The process of claim 10 wherein said flushing fluid is reintroduced into the engine through said internal lube oil distribution passage system after sequentially passing through a plurality of externally mounted associated filter media and through said oil filter.

12. The process of claim 7 wherein said flushing fluid consists essentially of:

an organic fluid selected from the group consisting of kerosene having a flash point above about 150° F;

an additive selected from the group consisting of DOWFAX, butyl cellosolve and mixtures thereof present in an amount sufficient to enchange detergency action of said flushing fluid; and a lubricant additive selected form the group consisting of methyl esters with carbon chains having between about twelve and about twenty carbon atoms, said lubricant additive being present in an amount sufficient to enhance sheeting action of said flushing fluid.

13. The process of claim 7 further comprising the steps of:

after removal of spent oil and introduced flushing fluid, introducing a preliminary portion of fresh oil into the engine through the fill line in communication with the internal lube oil distribution passage system, the preliminary portion of fresh oil being less than said measured amount of oil;

removing the introduced preliminary portion from the oil pan through the oil conveying conduit line.

14. The process of claim 13 wherein the preliminary portion of fresh oil contains greater amounts of detergency additives than those contained in the measured amount.

* * * * *